US005221079A

United States Patent [19]

Most et al.

[11] Patent Number: 5,221,079

[45] Date of Patent: Jun. 22, 1993

[54] APPARATUS FOR BRAKING A SUCCESSION OF SHEETS TO BE STACKED

[75] Inventors: Egbert Most, Düsseldorf; Ingo Becker, D'dorf; Ewald G. Welp, Erkrath; Albrecht Blume, D'dorf, all of Fed. Rep. of Germany

[73] Assignee: Jagenberg Aktiengesellschaft, Dusseldorf, Fed. Rep. of Germany

[21] Appl. No.: 894,713

[22] Filed: Jun. 5, 1992

[30] Foreign Application Priority Data

Jun. 13, 1991 [DE] Fed. Rep. of Germany ..... 4119511

[51] Int. Cl.[5] ..... B65H 29/66

[52] U.S. Cl. ..... 271/202; 271/204; 414/462

[58] Field of Search ..... 271/202, 204, 270, 271, 271/277, 123, 82, 206; 414/462

[56] References Cited

U.S. PATENT DOCUMENTS

| | | | |
|---|---|---|---|
| 3,685,823 | 8/1972 | Chambon | 271/270 |
| 3,724,840 | 4/1973 | Kuckhermann | 271/270 X |
| 3,841,625 | 10/1974 | Carricato | 271/206 X |
| 4,487,408 | 12/1984 | Fischer | 271/271 X |
| 4,534,550 | 8/1985 | Reist | 271/270 X |
| 4,657,237 | 4/1987 | Hansch | 271/202 X |
| 4,893,805 | 1/1990 | Eberle | 271/277 X |
| 4,898,373 | 2/1990 | Newsome | 271/202 X |
| 4,948,114 | 8/1990 | Bowman et al. | 271/271 X |
| 4,966,521 | 10/1990 | Frye et al. | 271/202 X |
| 5,081,821 | 1/1992 | Meires | 271/202 X |

FOREIGN PATENT DOCUMENTS

| | | | |
|---|---|---|---|
| 1436806 | 3/1969 | Fed. Rep. of Germany | 271/204 |
| 2000078 | 12/1973 | Fed. Rep. of Germany . | |
| 0765169 | 9/1980 | U.S.S.R. | 271/204 |
| 9108974 | 6/1991 | World Int. Prop. O. . | |

*Primary Examiner*—H. Grant Skaggs
*Assistant Examiner*—Carol Lynn Druzbick
*Attorney, Agent, or Firm*—Herbert Dubno

[57] ABSTRACT

A brake for a sheet feed to a stacking site in which the sheets are engaged by a belt drive from the location at which they are cut from a continuous web. The brake device has an endless belt with a brake stretch parallel to the travel plane of the sheets or declined downward slightly therefrom. The brake has at least one element with a shank over the belt and projecting above the plane at the inlet side of the braking device. The rear edge of the sheet is thus engaged by the shank and the brake belt is decelerated so that the sheet is delivered to the stack at the lower speed.

19 Claims, 10 Drawing Sheets

APPARATUS FOR BRAKING A SUCCESSION OF SHEETS TO BE STACKED

FIELD OF THE INVENTION

Our present invention relates to an apparatus for the braking of a succession of sheets fed to a stack and especially paper or cardboard sheets.

More particularly, the invention relates to an apparatus of the type in which the paper or cardboard sheets are fed by a belt conveyor with a spacing from one another in succession to the stacking location and are engageable by braking elements at a rear edge of the sheets in the direction of displacement thereof.

BACKGROUND OF THE INVENTION

In transverse cutting machines in which a web of a material, such as paper or cardboard, is subdivided into individual sheets transversely to the web, the sheets are generally fed at very high speeds by a belt-type conveyor to a stacking location at which the sheets are stacked on one another.

Because of the high speed of the sheets fed to the stacking location, it is essential to brake the sheets before they are deposited on the stack in order to allow reliable stacking and prevent a rapidly moving sheet from interfering with the uniformity and continuity of the stacking process.

DE-B 20 000 78 describes a device for this purpose in which the sheets are guided over a suction chamber or box with a fixed perforated surface through which a suction is drawn, the suction box being switched cyclically to draw the rear edge or portion of the sheet against the surface of the suction box and thereby brake the sheet. The sheet is then engaged by belts which run at the sheet deposition speed to the stacking site. The sheet deposition speed, of course, is the speed at which the sheet is deposited on the stack.

Since the subsequent sheet is initially unbraked, its leading edge can pass over the rear edge of the braked sheet so that the sheets overlap and are further displaced in a shingled or overlapping stream.

Since the suction force is only effective on the lowermost sheets, with a multilayer operation in which, for example, eight webs are guided one above the other to the cutter for simultaneously cutting into sheets, in effect, packets of eight sheets must be fed to the stacking location, the entire sheet packet must be braked and this cannot be effectively done utilizing a suction box in the manner described.

For the purpose of handling such packets, belts inclined to the feed plane must be used and the leading edges of the sheet packet can abut the inclined belt or belts.

This type of brake device has been found to be structurally expensive and cannot be used effectively with sensitive papers, i.e. papers which are sensitive to crinkling or marking, since the relative speeds of the elements give rise to undesirable marking of the sheets. At high operating speeds, moreover, the sheets can shift.

To avoid these drawbacks, the International application PCT/EP 90/02143 provides for the braking of the sheets, synchronously operating clamping elements with clamping zones which engage the rear edges of the sheets at least in part in a clamping operation as these clamping elements are circulated.

At the clamping zones where these elements engage the sheets, they are driven at the feed or inlet speed of the sheet. Beyond the clamping zone, however, they are braked to the discharge speed at which the sheets are delivered to the stack. At the lower, discharge, speed, the sheet is frictionally held and the clamping of the sheet is released. The clamping zone is then accelerated to the inlet speed of the sheet before its clamping element engages a successive sheet.

According to an embodiment of this system, to both sides of the transport plane of the sheets, endless belts are provided with nonuniform drives with at least the belts on one side being provided along the exterior with at least one clamping body whose surface defines the circulating clamping zone. The inner stretches of the belt run parallel to or at an acute angle to the transport plane, the inclination being in the transport direction. This device provides reduced strain on the sheets and higher operational reliability.

However, with this system as well as with other prior art systems there are limits to the operating speed since the rear edges of the sheets must be clampingly engaged by an element from above and, cyclically following the deceleration, must be moved again to an open position and brought to the inlet speed. The braking process must be complete before overlapping by the next sheet begins since, for such overlapping, it is desirable to move the clamping body out of the feed plane for the next sheet. Toward the end of the deceleration phase there must be a residual gap before the subsequent sheet is provided to avoid an engagement of the leading edge of that sheet by providing time before its arrival for the clamping body to reach its upper most position.

The time interval which is allowed for this movement of the clamping body and thus which is available between the leading edge of the next sheet and the previous sheet can be increased by separating the sheets even before their braking by relatively large gaps and transporting them on the conveyor with such gaps.

For given basic speeds, an increase in the gaps can be achieved only by accelerating the sheets to a greater inlet speed.

Apart from the fact that the requisite higher acceleration levels prior to braking requires higher braking powers to achieve the relative low outlet speed of the sheet, there is an increasing loading of the sheet which puts limits on the suitability of this structure.

OBJECTS OF THE INVENTION

It is, the principal object of the present invention to provide an improved apparatus of the aforedescribed type which will allow slip free braking of sheets and even sheet packets arriving at higher operating speeds whereby the work required to brake the sheets and any loads applied to the sheets can be significantly diminished.

Another object of the invention is to provide an improved sheet braking apparatus whereby drawbacks of earlier systems are obviated.

SUMMARY OF THE INVENTION

These objects and others which will become apparent hereinafter are attained, in accordance with the invention, in an apparatus for the braking of sheets and especially paper and cardboard sheets where the sheets are fed in a transport plane of said plane by a belt conveyor at high speed, the braking apparatus having the following combination of features:

a circulating belt is provided below the said plane adjoining the belt conveyor, a stretch of the circulating belt runs in parallel with the feed plane, but preferably somewhat below it, parallel to the feed plane or inclined somewhat in the sheet feed direction, on its outer side the belt has at least one clamping element affixed thereto, the clamping element has a clamping shank extending in the direction of circulation of the belt or in the feed direction of the sheets, the clamping element opens at an acute angle to the belt as it is deflected on a roller at its inlet side whereby its clamping end at the inlet side before closing extends above the feed plane, in the brake stretch the belt lies against the clamping shank in a clamping manner and the circulating belt is provided with a nonuniform drive. Of course, when we indicate that the shank or end of the shank lies against the belt in the clamping position, we mean that an edge of the engaged sheet is gripped between the belt and the clamping shank.

More particularly, the apparatus for braking a succession of sheets can comprise:

a belt conveyor feeding a succession of sheets in a feed plane;

at least one braking belt guided in a closed path below the plane and having an upper stretch extending along the plane in a feed direction of the sheets;

at least one clamping element affixed on an outer side of the braking belt and comprising a clamping shank extending in the direction, engageable over a rear edge of a sheet to be gripped by the clamping element and adapted to press toward the braking belt to hold a clamped sheet thereagainst, the shank upon passage onto the upper stretch including an acute angle with the braking belt on opening of the clamping element and having a free end projecting above the feed plane; and a nonuniform drive operatively connected with the braking belt for initially driving same at a higher speed upon engagement of the clamping element with the rear edge of a respective sheet and then at a reduced speed for delivery of the sheet.

According to the invention, clamping elements engage the rear edges of the sheets in succession and at the end of the deceleration phase are moved exclusively downwardly away from the path of the sheets. Since no delay elements are moved upwardly, the brake device can operate with minimum gaps between the sheets. The system can operate, therefore, also with a reduced inlet speed.

The clamping elements can be so shaped that already during the deceleration of a previous sheet, the leading edge of a subsequent sheet can pass over the rear edge of the preceding sheet. The clamping elements can thus simultaneously form guide elements of the sheets enabling these to overlap the rear edges of the preceding sheets.

According to a feature of the invention, the aforementioned stretch is parallel to the said plane. In an alternative, the stretch is inclined slightly downwardly away from the feed plane in the direction of movement of the sheets to the stacking site.

The braking belt can be one of a plurality of parallel transversely spaced braking belts each of which is provided with at least one of the clamping elements.

The end of the shank engageable with the rear end of a clamped sheet can be provided with an inwardly projecting formation parallel to the side of the braking belt turned toward the sheet and, in a closed position of the clamping element, engaging flatly against a sheet clamped between that element and this side of the braking belt.

According to a feature of the invention a guide table can support this stretch from below and can be a suction table and the braking belt can have suction holes ahead of a clamping region of the braking belt in the direction of advance of the sheets.

The shank can be formed with a magnetically attractable material and a magnet can be provided below the shank to reinforce a clamping force with which the shank bears against the sheet. When a guide table supports the stretch from below the magnet can be provided on the table. Alternatively, the magnet can be provided directly on the braking belt.

When the braking belt is one of a plurality of parallel transversely spaced apart braking belts, guide belts can be provided above this plane in the gap between the braking belts. The guide belts can be perforated and can pass below a suction box opening toward the plane over at least part of the length of the stretch.

The nonuniform drive means can include a nonuniformly controlled motor operatively connected to the braking belt, a nonuniformly operated speed changing transmission interpose between the motor and the braking belt, and a setting transmission operatively connected to the nonuniformly operated speed changing transmission. A flywheel can be connected to the motor.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
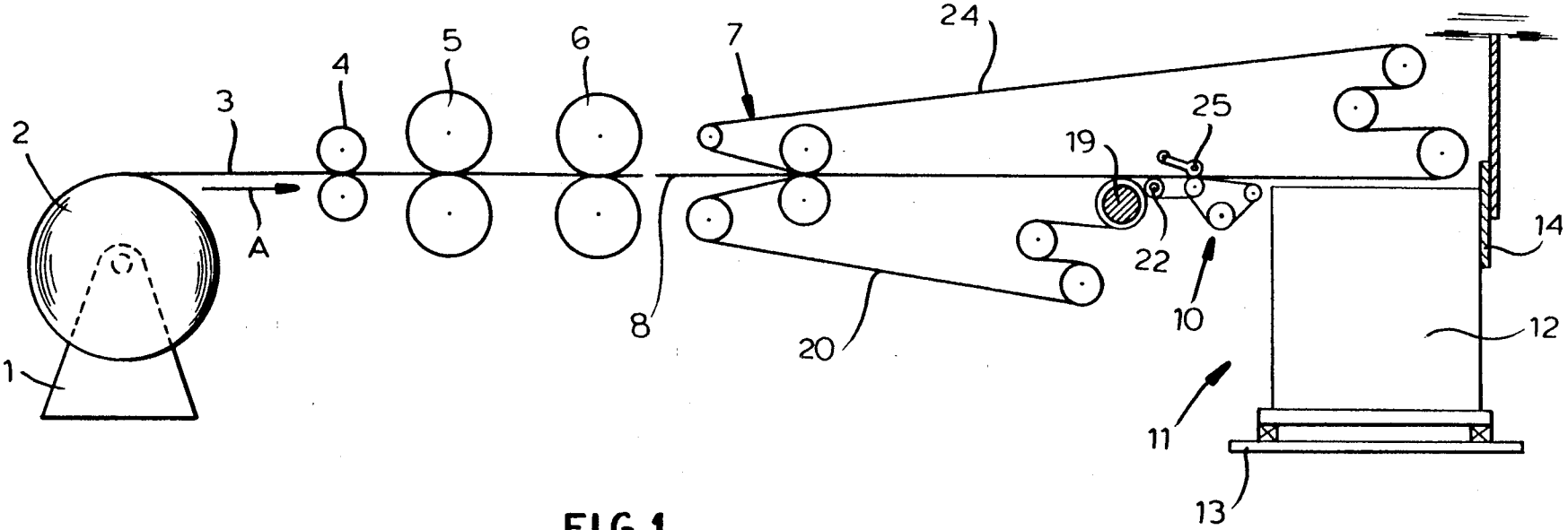
FIG. 1 is a side elevational view of a transverse cutter system in which the brake device is provided immediately upstream of the stacking station.
Figure 2:
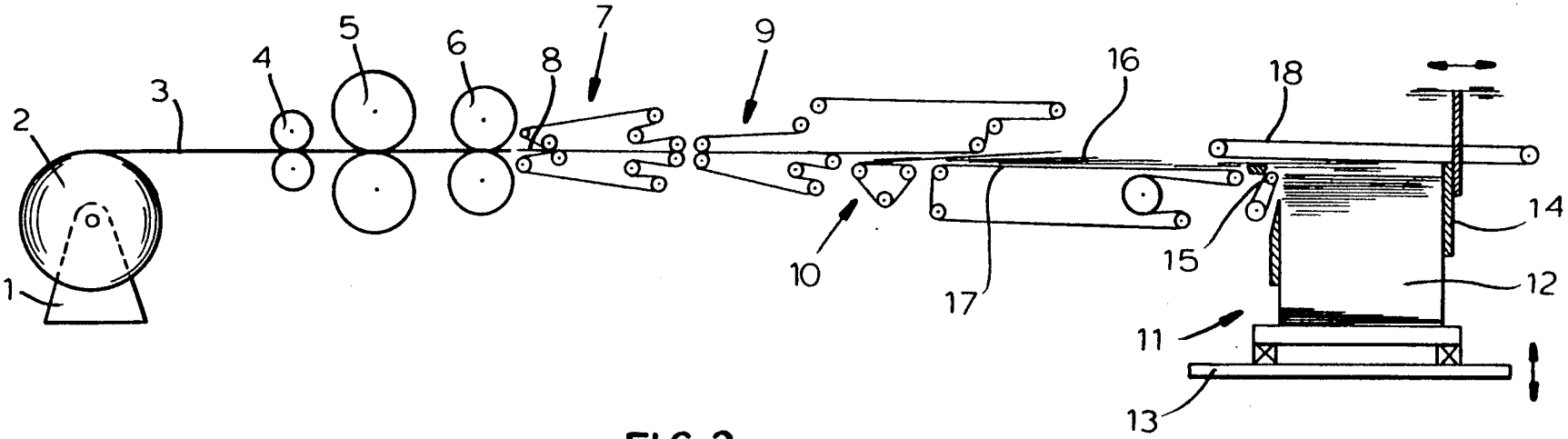
FIG. 2 is a view similar to FIG. 1 in which the stacking device is provided before a shingled stream of the sheets is produced.

The transverse cutting machine shown in FIGS. 1 and 2 comprises a web supply unit in which, from a stand 1, the web is supplied from one or more supply rolls which are suspended in the roll stand or stands 1. One or more webs 3 are withdrawn from the roll and it is not uncommon for 8 such webs to be fed one above the other to the cutting position for simultaneous cutting into sheets. Thus, while only a single web will be referred to here, a multiplicity of layers of such webs is intended by reference to the single web and reference to a single web sheet may be considered to be reference to a pack of sheets, e.g. 8 sheets.

Indeed, it is quite common for the subdivision of paper into sheets to simultaneously cut 8 webs and form such packs.

The web passes through a longitudinal slitting assembly represented at 4 which can cut the web into a multiplicity of side by side webs, each of which is to be subdivided into sheets or sheet stacks. Downstream of the longitudinal cutter 4 is a drawing device 5 represented as a pair of rollers which are driven to advance the web in the direction of the arrow A.

From the drive 5, the web is passed through a flying blade cutter 6 which severs the web transversely of the direction A and its longitudinal dimension into sheets or sheet packets 8. The sheets immediately are engaged by a belt conveyor 7 which accelerates the sheets in the direction A to create a gap between the successive sheets.

The belts of the conveyor 7 operate with a speed which is greater by 5 to 100% than the speed of the feeder 5, preferably a maximum of 30% higher than the speed of feeder 5. If greater lead values, say more than 10%, are required, a multistage conveyor arrangement can be used to accelerate the sheets away from the cutter. In FIG. 2 a two stage accelerator is provided in which conveyor 7 is followed by a second belt conveyor 9 operating at a higher speed than the first belt conveyor. The brake device 10 in the embodiment of FIG. 2 is provided downstream of the second belt conveyor 9 whereas it is immediately downstream of the single belt conveyor 7 in the embodiment of FIG. 1.

The brake device 10 has been illustrated in detail in FIGS. 3 to 7.

Downstream of the brake device 10, a station 11 is provided upon which a stack 12 of the sheets can be built. The stacker 11 can comprise a raisable and lowerable platform 13, an adjustable stop 14 for the leading edges of the sheets, driven transfer rollers 15 for effecting a transition between the brake belt and the stack, lateral vibratory plates to align the lateral edges of the sheets in the stack, if desired, and, if desired, longitudinally extending separator plates or partitions in case of a number of stacks are to be formed side by side.

As noted, in the embodiment of FIG. 1 the brake device 10 is provided directly upstream of the stacking unit 11 so that the sheets 8 directly after braking deposit in the stack. In the embodiment of FIG. 2, however, the brake device 10 is spaced from the stack forming unit 11 and here a shingled pattern of the sheets is formed at 16 and displaced by conveyor belt 17 to the stacker 11 and then deposited in the stack. In this embodiment as well, the stacker is formed with the elements which have been described for it and which may be referred to hereinafter as stack forming elements.

At the inlet side, the conveyor belt 17 begins at a short distance downstream of the brake device and the shingled stream 16 is offset somewhat downwardly from the said plane of the brake unit 10. Above the stack 12 there are provided further belts 18 which support the transport to the stack 12.

Figure 3:
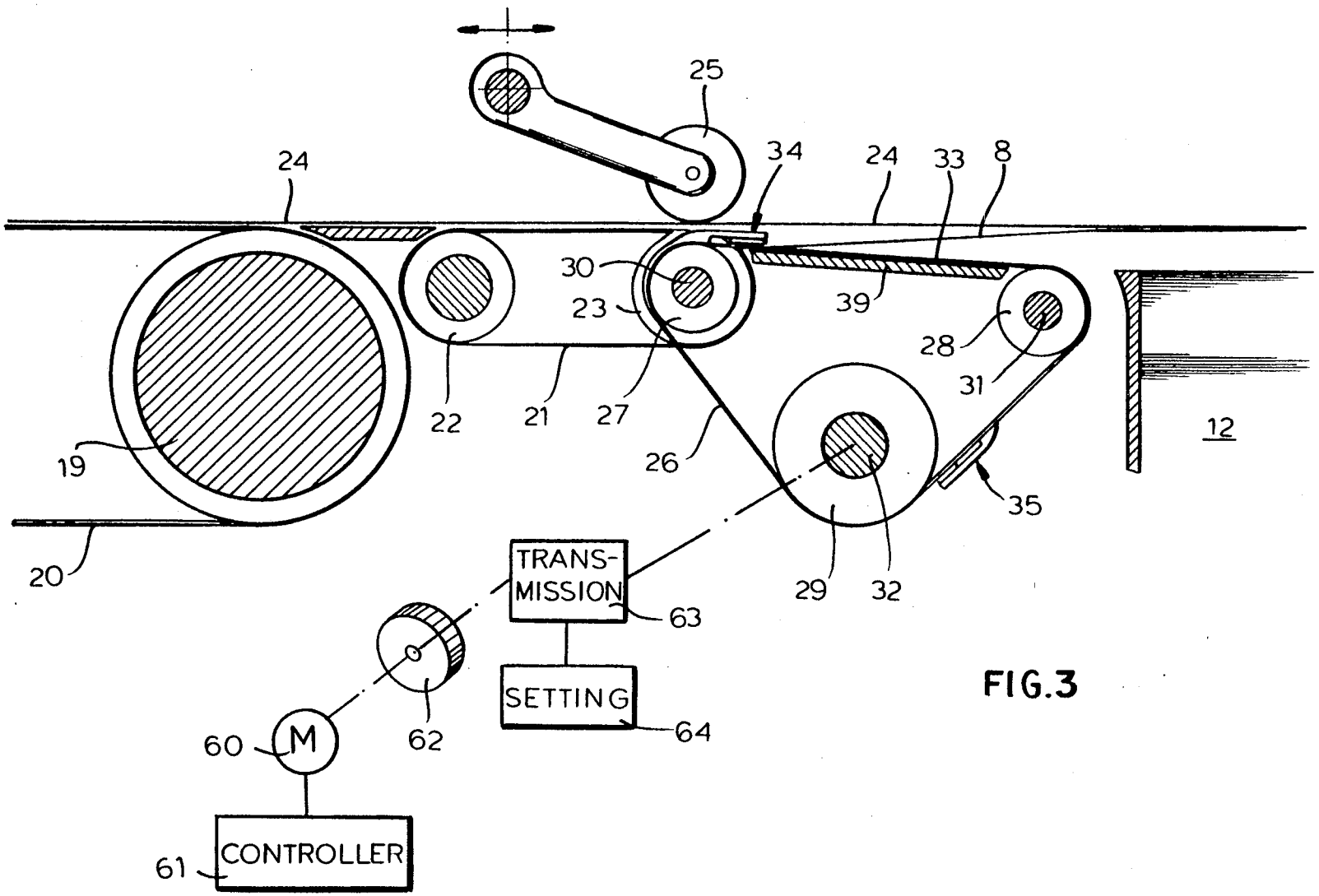
FIG. 3 is a detailed view of the brake device of FIG. 1 in longitudinal section and drawn to a larger scale than FIG. 1.

The brake device 10, shown to an enlarged scale in FIG. 3, corresponds to the embodiment of FIG. 1 and thus it is disposed immediately upstream of the stacker 11. The sheets 8 are thus stacked directly after being braked and so that during the stacking, the leading edge of the subsequent sheet 8 is shoved over the trailing or rear edge or prior sheet 8.

Because the sheets 8 are displaced over the entire feed stretch directly following the outlet side guide roll 19 of the lower belt 20 of the conveyor belt 7, there is a shorter belt conveyor, constituted of a plurality of belts 21 which are spaced from one another and pass around guide rollers 22 and 23. The upper belts 24 of the conveyor 7 are formed as guide belts for the sheets until they come into the region of the stacker 11.

Above the outlet side guide roll 23, a pressing roller 25 is provided which presses the upper belts 24 against the rollers 23 about which the belts 21 pass. Since the sheets are guided between the belts here, the roller 25 additionally serves to prevent shifting of the sheets 8 transversely when they are engaged by the braking device 10.

The brake device 10 (FIGS. 3–7) comprises endless belts 26 which run below the feed plane of the sheets and are referred to herein as the braking belts. The belts 26 run about three belt pulleys or wheels 27, 28, 29. Over the working width of the machine, a plurality of these belts 26 are disposed in spaced relationship from one another. These belts are internally toothed and can be referred to as cog belts or timing belts or the like. In the gaps between the belts 26, the upper belts 24 can be disposed.

The pulleys 27, 28 and 29 are cog pulleys or sprockets which can be affixed to shafts 30, 31 and 32 also extending the full width of the machine. The inlet-side shaft 30 can form the support shaft for the pulleys 23 of the belt or belts 21 which form a transfer conveyor for the sheets from the conveyor 7 to the braking device 10.

The pulleys 27 are thus coaxial with the pulleys 23 which freely rotate upon the shaft 30. The pulleys 23 have somewhat larger diameters than the pulleys 27 of the braking device 10.

The discharge side shaft 31 carrying the pulleys 28 is at a distance from the shaft 30 between 30 mm and the maximum sheet length to be produced, preferably between 50 mm and 500 mm. These shafts 30 and 31 are so oriented that the upper stretch 33, referred to as the braking stretch, of the braking belts 26 is in the region of the said plane but preferably is located somewhat below the said plane, either parallel to the feed plane or, as shown in the drawing, inclined slightly downwardly therefrom. The third shaft 32 is located below the transport plane.

On the outer side of each belt 26, at least one clamping element 34 or 35 is fastened. Preferably, such elements are provided per belt and are spaced apart from one another along the belt as shown by a distance equal to twice the desired deceleration stretch. This makes the length of each belt 26 four times the length of the deceleration stretch, the acceleration time and deceleration time can be both equal to half the cycle time.

If these conditions are not met, the belt 26 can have a simpler construction and need only pass over two pulleys.

The shafts 30, 31 and 32 are journaled at their ends in journaled blocks which are fastened on lateral frame parts on the transverse cutting machine.

One of the shafts 30, 31 and 32, preferably the lower shaft 32 is connected to a drive motor and, if desired, a more complex drive system. The other shafts 30 and 31 and/or the pulleys 27 and 28 thereof can be idlers. The drive motor is nonuniformly controlled to impart a braking peripheral speed to the belts 6 and then to accelerate them. The drive motor can be directly flanged on the shaft 32 for the case at which it can be controlled to match the torques and/or speeds required. Alternatively, a transmission with fixed or variable transmission ratio can be provided between the drive motor and the shaft 32.

By way of a diagrammatic illustration, the motor 60 may be provided with a control 61 so that it can be switched between high and low speeds to accelerate or decelerate the belts directly, and/or can be connected to a flywheel 62 as will be described.

If the acceleration and deceleration are not effected at the motor directly, a transmission 63 can be interposed between the motor and the shaft 32 and can be capable of shifting to increase or decrease the shaft speed. If desired, a separate setting unit 64 can be provided to shift the transmission or switch the latter between speeds.

So that the nonuniform speed of the belt 26 can be varied within a maximally wide range in dependence upon the format and size of the sheets, and so that the gaps between the sheets can be varied also within a wide range, the inlet speed and the desired outlet speed can be varied utilizing, instead of a transmission with uniform transmission ratios, a transmission with nonuniform transmission ratios, especially a coupling transmission. When the nonuniform transmission can operate through or in conjunction with one or more settable transmissions, so that the degree of nonuniformity of the overall transmission ratio can be selected, it is possible to vary the speed of the shaft 32 and the peripheral speeds of the belts 36 to the desired degree.

Another alternative to a nonuniformly controlled electric motor, is a uniformly driven motor, which may work with or without the flywheel so that the nonuniform speed of the brake belts is brought about by the nonuniform operation of the transmission, again especially a coupling transmission.

Figure 13:
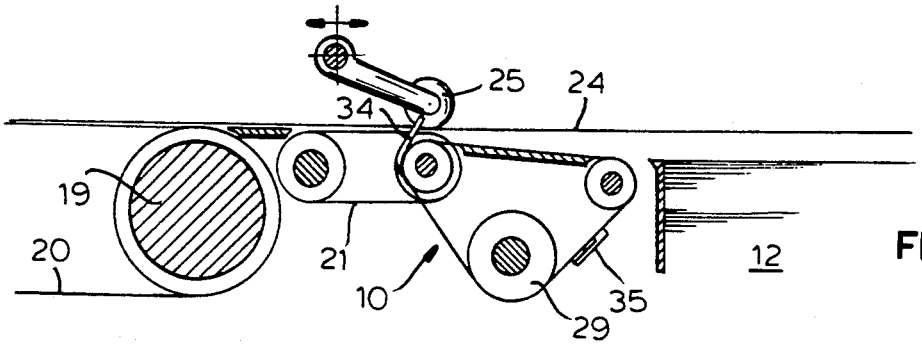

As can be seen from FIGS. 8 to 11, each clamping element 34, 35 can comprise a clamping shank 36 which is so connected to the outer side of the respective belt 26 that, in an open condition as the clamping element passes around the pulley 27, the shank forms an acute angle in the travel direction of the belt with the surface of the belt. This acute angle is best visible from FIGS. 10, 11 and 13.

In the closed condition of the clamp, the clamping shank 36 has its free end engaged with a sheet and juxtaposed with the outer surface of the belt 26. For a flat clamping contact, the clamp shank 36 at its free end is provided with a projection 37 having a surface parallel to the outer surface of the belt 26 in the stretch 33.

Preferably the clamping shank 36 is fastened with prestress on the belt 26 so that its free end presses with this prestress toward the belt and only is lifted at an acute angle from the latter as it passes around the pulley. As can be seen from FIG. 13, for example, the acute angle opens in the direction of travel of the sheets so that the clamp can automatically open swiftly to engage the rear edge of a sheet or stack of sheets. The upper stretch 33 of the belt 26 is so oriented that upon opening of the clamp at the inlet side as it passes around the pulley 27, the clamping end of the shank 36 will lie above the plane along which the sheets are fed prior to closing of the clamping.

Figure 8:
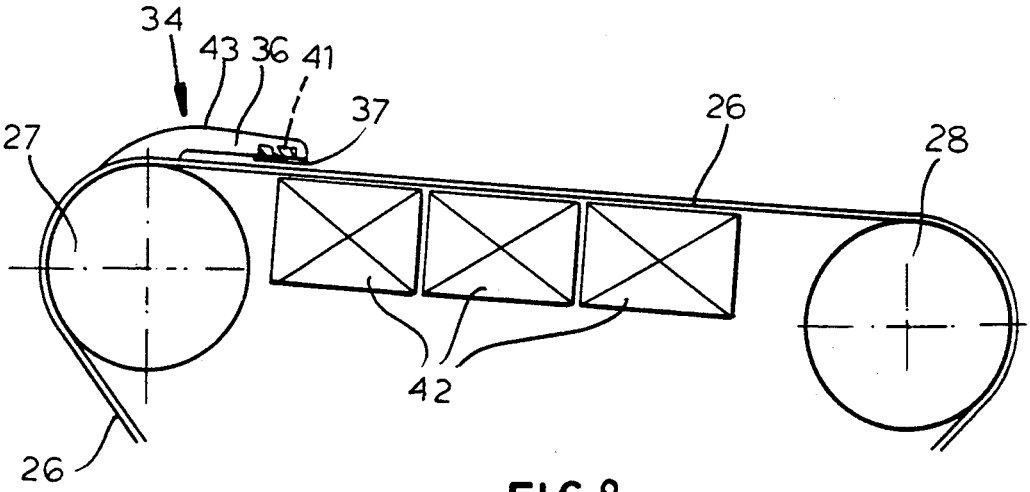
FIG. 8 is a highly schematic illustration of a brake device in which ferromagnetic material in the clamp shanks can be drawn toward the surface of the brake belt by magnets in the guide table.
Figure 9:
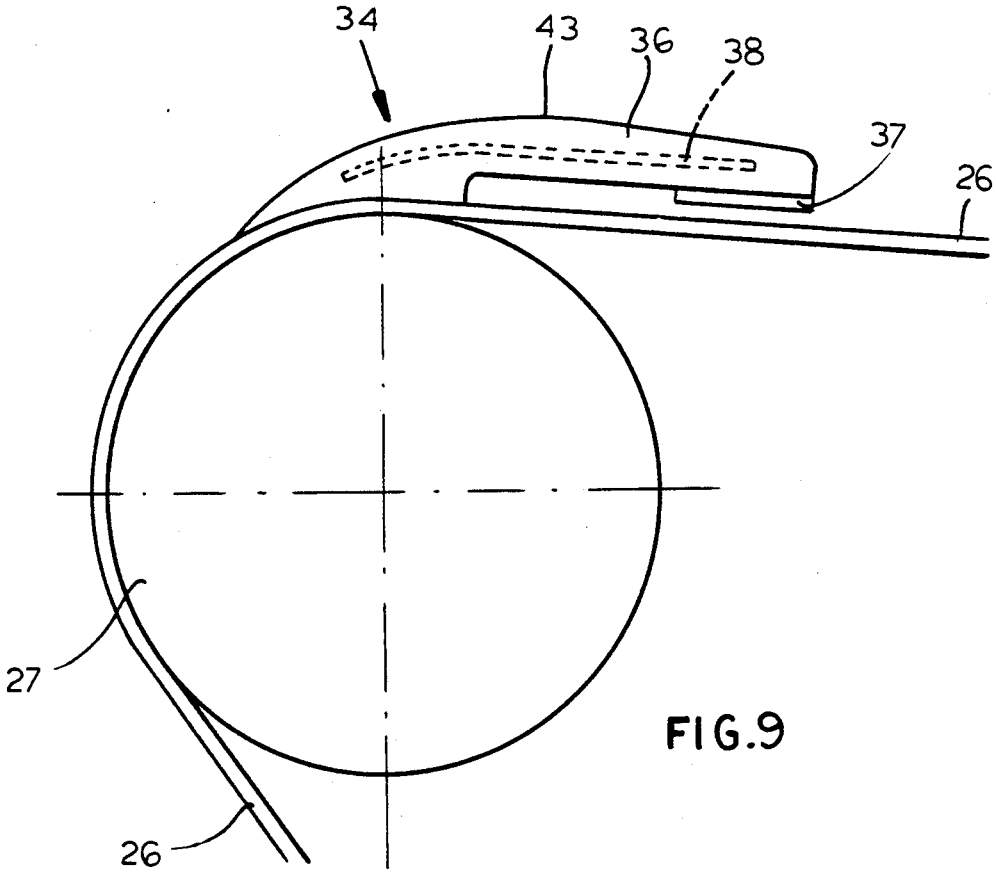
FIG. 9 is a detailed view of the clamp shank of a clamping element showing a leaf spring therein.

In FIGS. 8 and 9, the belt 26 is shown to have a clamping element 34 which is composed of an elastic material. When the belt 26 is stretched, the projecting end of the shank 36 is pressed toward the belt surface. If the shank 36 is to have an increased stiffness then is required for the remainder of the belt, the shank can have, as FIG. 9 shows, a sheet metal insert 38 embedded therein. This insert can be composed of spring steel.

Figure 10:
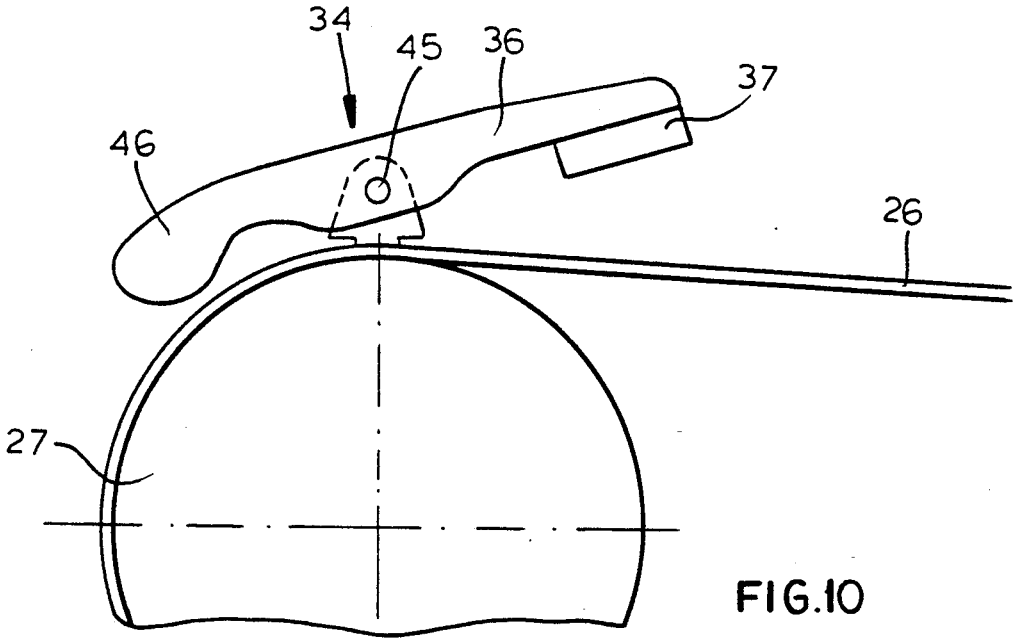
FIGS. 10 and 11 are detailed views of clamping elements operating in accordance with lever principles.
Figure 11:
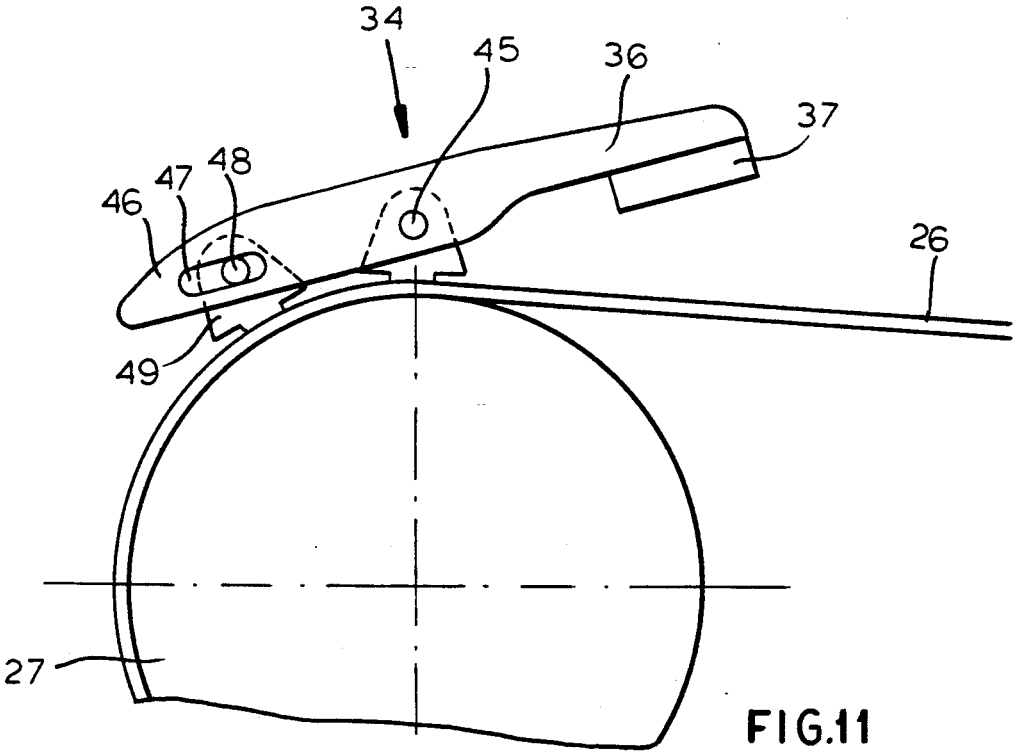
Figure 12:
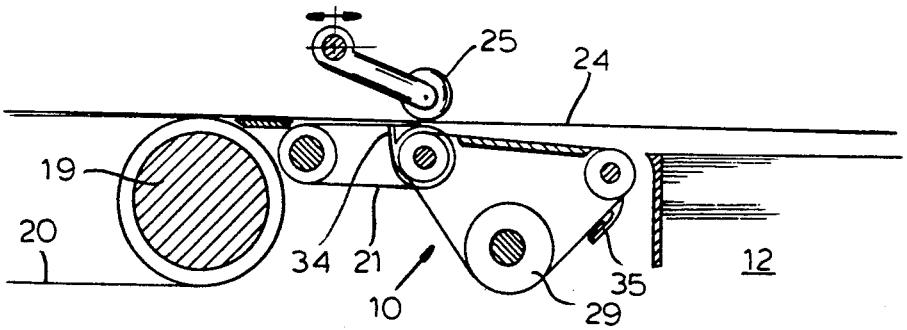
FIGS. 12 through 16 are longitudinal sectional views in highly diagrammatic form constituting a sequence diagram of the successive positions of the clamp elements.

An alternative to the shanks 36 previously described which will provide the prestress on the belt 26, has been shown in FIGS. 10 and 11 where the shanks 36 are somewhat centrally fulcrummed on the pivots 45 on the belt 36. Each clamping shank 36 thus has a clamping end as previously described as well as an extension 46 in the opposite direction from the clamping end so that, upon stretching of the belt, the extension is pressed outwardly to urge the clamping end with its projection 37 toward the belt 26

As the belt passes around the pulley 27, the shank 36 opens, as has been illustrated in FIG. 10, since in this case the extension 46 is not pressed outwardly.

In the embodiment of FIG. 11, the extension 46 is additionally articulated to the belt 26 so that the opening and closing of the clamp is forced as the clamp passes around the pulley 27. For this purpose, the extension 46 has a slot 47 in which a pin 48 is engaged with relative movement, this pin 48 being connected to the belt by a support element 49.

Figure 4:
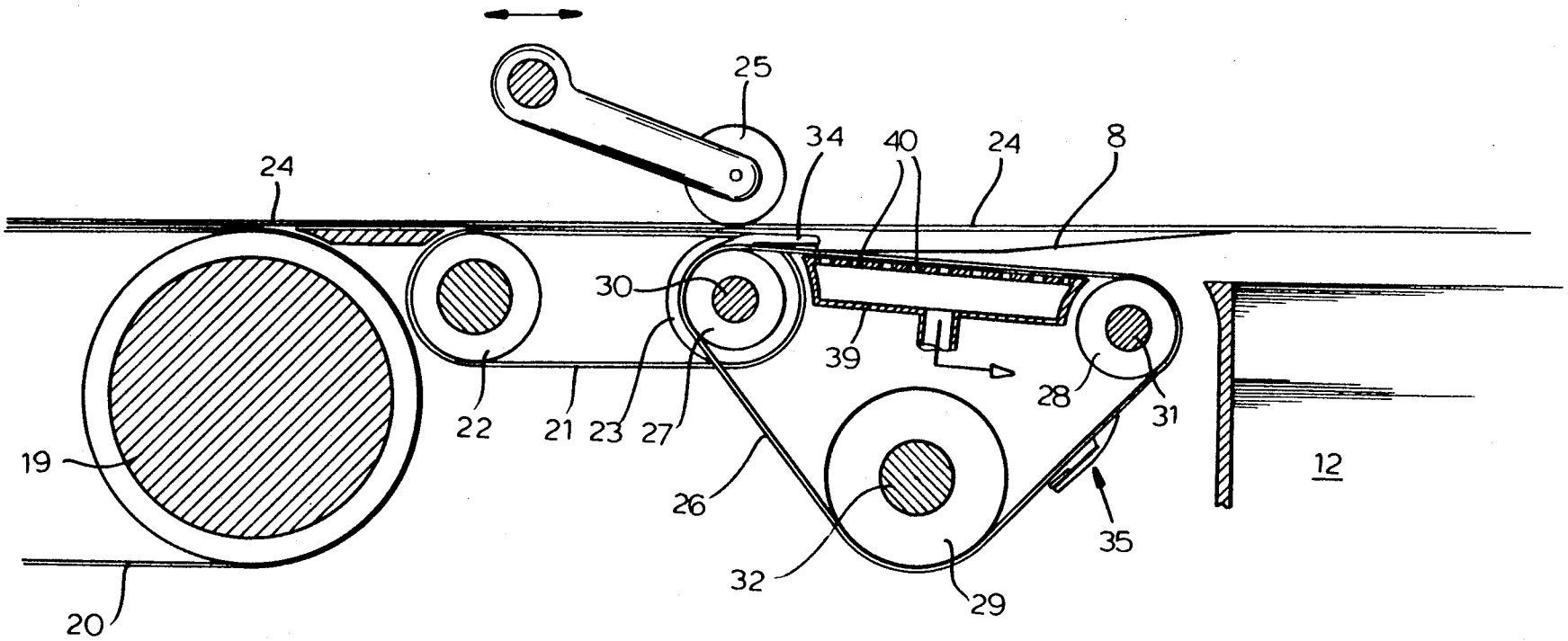
FIG. 4 is a view similar to FIG. 3 showing a brake device provided with a suction table.
Figure 5:
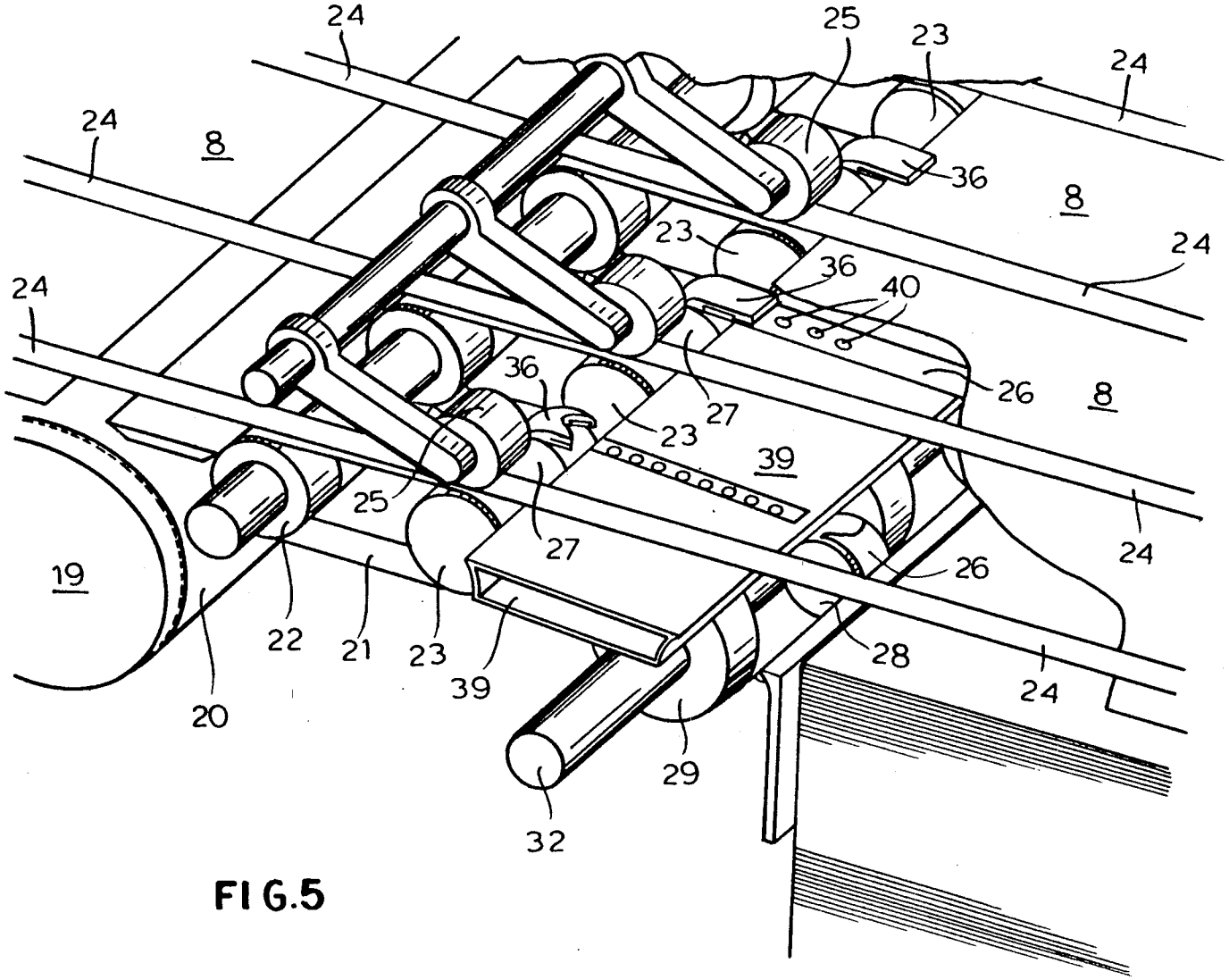
FIG. 5 is a perspective view of a portion of the brake device of FIG. 4.
Figure 6:
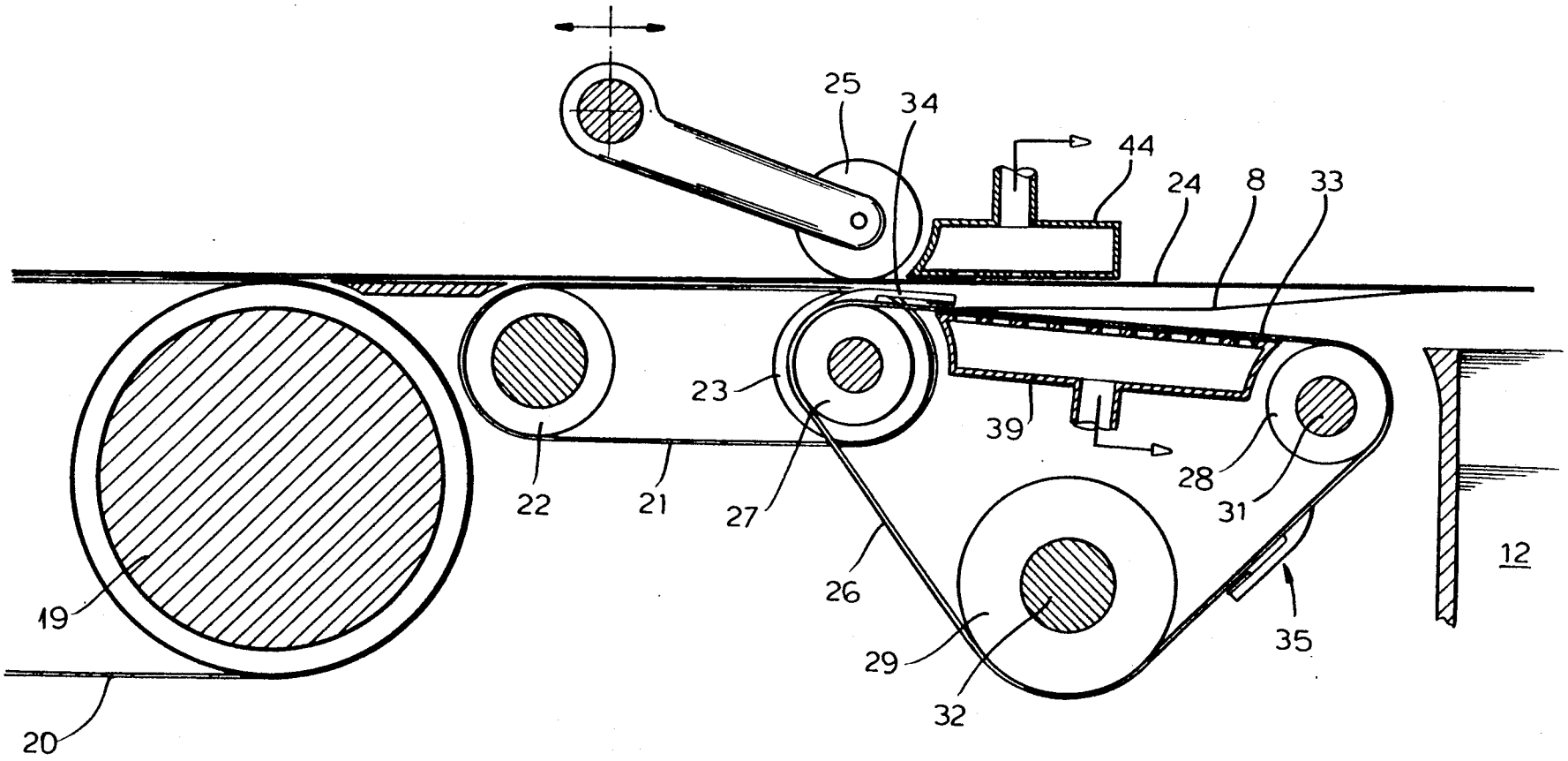
FIG. 6 is a longitudinal section of a brake device which additionally has a suction box above the brake stretch.
Figure 7:
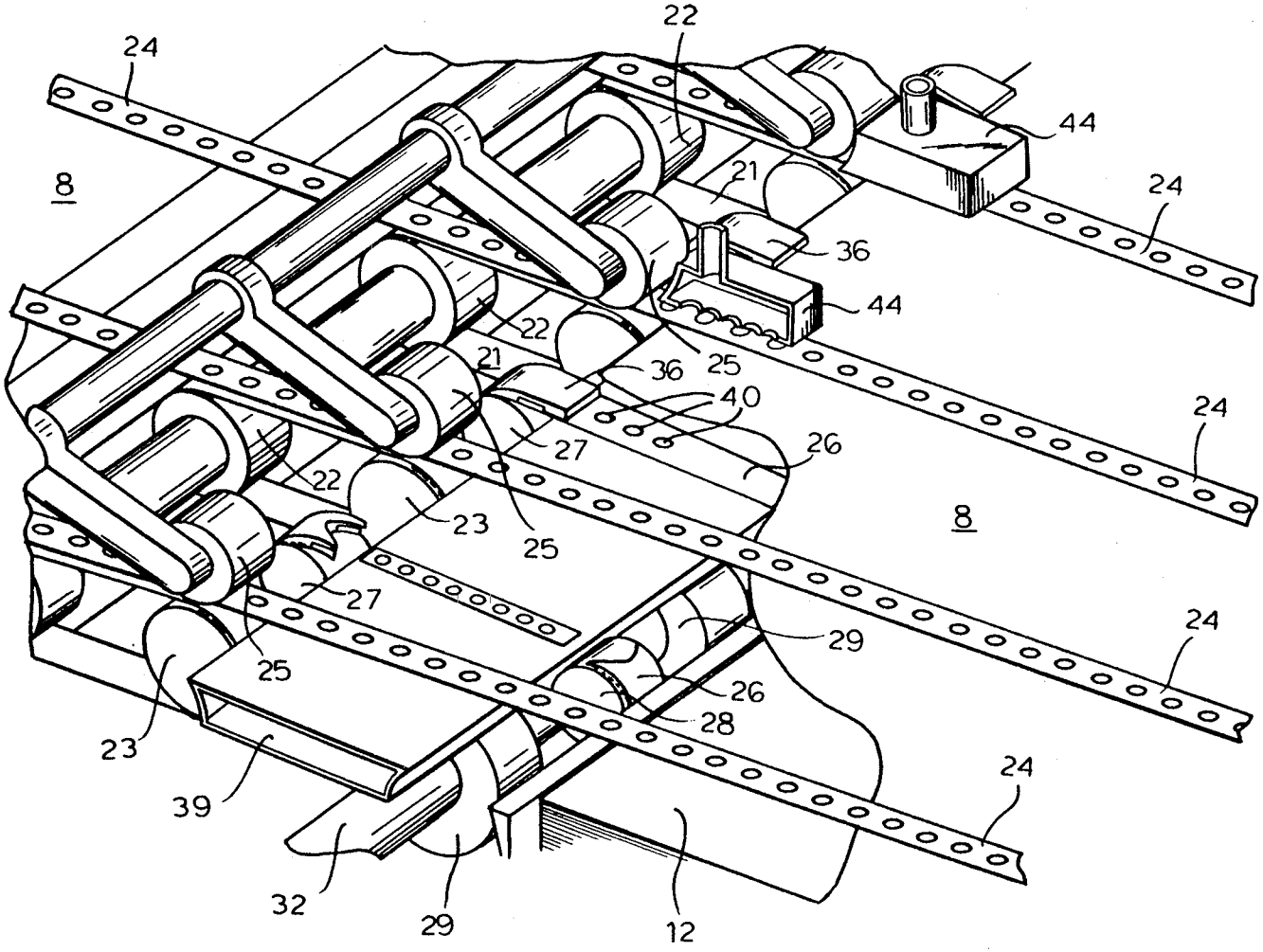
FIG. 7 is a perspective view of the brake device of FIG. 6.

So that the belt 26 is not deformed under the pressing force of the clamping shank 36, the upper stretch 33 of the belt may be supported by a guide table 39 (FIG. 3) preferably, the guide table 39, as shown in FIGS. 4 and 5, which is formed as a suction table and the belt 26, in the direction of travel has ahead of the clamping region suction holes 40 so that suction applied through these holes will assist in drawing the sheets toward the belt 26 and retaining the sheet on the belt 26. This guarantee that the sheet will be drawn onto the belt 26 without difficulty from the travel plane of the sheets.

To reinforce the clamping force, the clamping elements 34 and 35 and especially the shanks 36 thereof (FIG. 8) can include a body of ferromagnetic material 41 and in the clamping region of the belt 26 or in the guide table 39 permanent or electromagnets 32 can be provided which additionally draw the shank 36 in the region of the stretch 33 toward the belt 26.

Figure 14:
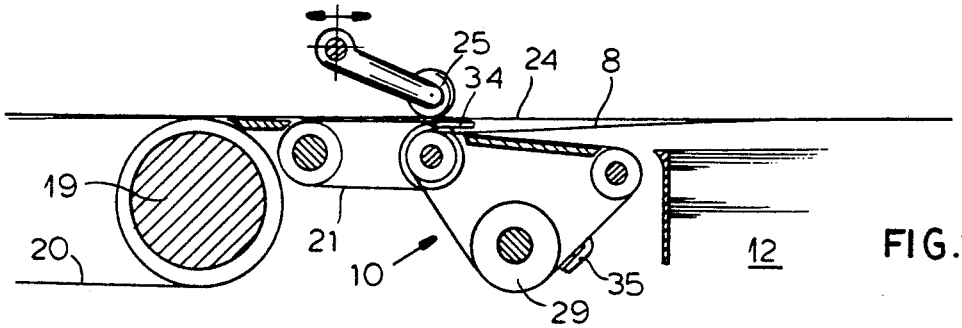
Figure 15:
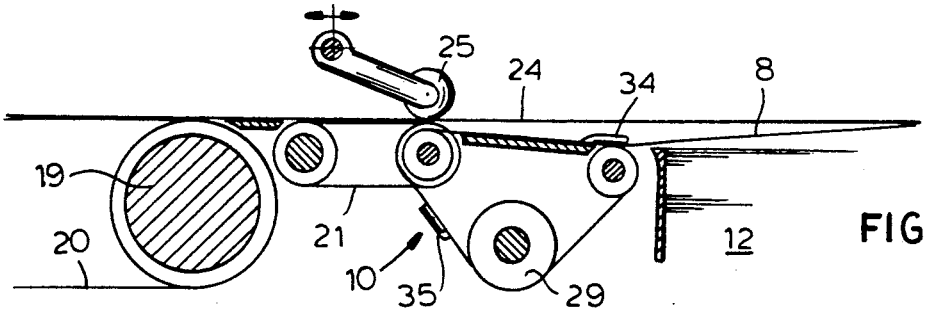
Figure 16:
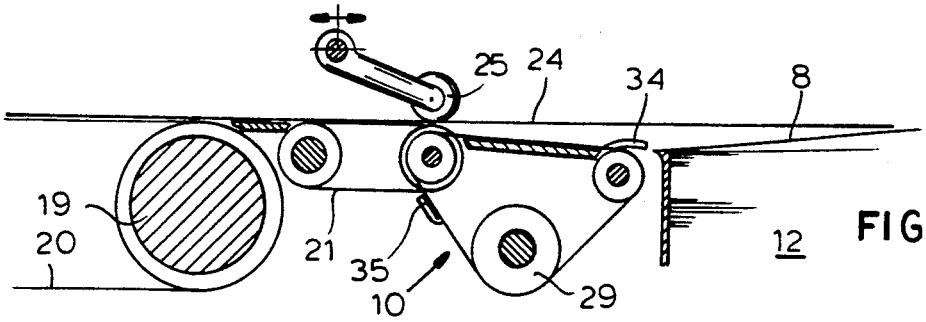

The steps involved in the braking process have been illustrated in FIGS. 12 to 16. The circulation of the belt 26 is so arranged that, as soon as a sheet 8 has its rear end passing over the pulley 27, the shank 36 of one of the clamps 34, 35 opens above the sheet travel plane (FIGS. 12 and 13) because of the higher speed of the elevated clamping end of the shank relative to the belt speed, this end engages over the rear edge of the sheet and as the clamp travels beyond the rollers 27, crosses on the end of the sheet. The clamping shank 36 thus presses toward the belt 26 which is supported by the guide table 39 and clamps the sheet against the belt (FIG. 14).

When a suction table is provided, the suction is applied through the openings 40 in the belts 26 simultaneously to draw the sheet from the travel plane onto the belt 26 so that the sheet is held frictionally against the latter without slip.

As soon as the rear edge of the sheet is clamped, or somewhat later if the path of the clamp is sufficient, the circumferential speed is braked in a slip-free manner to the desired outlet speed without relative movement of the sheet 8 with respect to the clamp in which it is engaged. The leading edge of the next sheet thus approaches the clamp (FIG. 15) and can ride thereover. Meanwhile, the sheet 8 has overridden the previously deposited sheet on the stack.

At the end of the braking stretch (FIG. 16), as the belt deflects around the pulley 28, the clamp opens to free the sheet which passes at reduced speed and by inertia onto the stack 12. The leading edge of the following sheet, as yet unbraked, can overlap the clamp 34 even before its rear edge is engaged by the clamp 35 to repeat the process. The passage of the leading edge of a subsequent sheet over the rear edge of a previous sheet can be facilitated by the slight inclination of the brake stretch 33 which has been illustrated additionally, suction can be applied from above, if desired, to hold the sheet up until its leading edge passes over the clamp which has engaged the trailing edge of the previous sheet. This is facilitated by the suction box 44 and the perforated upper belts 24. The suction is applicable in at least a portion of the region above the brake stretch 33 (see FIGS. 6 and 7). Before the rear edge of the subsequent sheet 8 has reached the inlet side pulleys 27, the belt 26 is again accelerated to the inlet speed so that the clamp 35 opens above the travel plane and can engage the rear edge of this subsequent sheet.

Since the distance between the two clamps 34, 35 is twice the length of the brake stretch, the second clamp 35 at the end of the braking of the clamp 34 is located just upstream of the pulleys 27 so that the same requirements of acceleration and deceleration apply to both clamps. The acceleration time can be equal to the deceleration time and thus the tarque of the drive motor can be optimally used for high speed operations of the machine.

Especially when a long sheet format (size) is used, it is possible following the braking operation to bring the clamping operation at the outlet side of the stretch 33 practically to standstill and then accelerate the belt 26 after a waiting interval to present one of the clamps to the rear edge of the subsequent sheet.

We claim:

1. An apparatus for braking a succession of sheets, comprising:

a belt conveyor feeding a succession of sheets in a feed plane;

at least one braking belt guided in a closed path below said plane and having an upper stretch extending along said plane in a feed direction of said sheets;

at least one clamping element affixed on an outer side of said braking belt and comprising a clamping shank extending in said direction, engageable over a rear edge of a sheet to be gripped by the clamping element and adapted to press toward said braking belt to hold a clamped sheet thereagainst, said shank upon passage onto said upper stretch including an acute angle with said braking belt on opening of said clamping element and having a free end projecting above said feed plane; and a nonuniform drive operatively connected with said braking belt for initially driving same at a higher speed upon engagement of said clamping element with said rear edge of a respective sheet and then at a reduced speed for delivery of the sheet.

2. The apparatus defined in claim 1 wherein said sheets are sheets of paper or cardboard.

3. The apparatus defined in claim 1 wherein said stretch is parallel to said plane.

4. The apparatus defined in claim 1 wherein said stretch is inclined slightly downwardly away from said plane in said direction.

5. The apparatus defined in claim 1 wherein said braking belt is one of a plurality of parallel transversely spaced apart braking belts, each of which is provided with at least one of said clamping elements.

6. The apparatus defined in claim 1 wherein said shank, in a closed position of said clamping element, lies substantially parallel to said side of said braking belt and to said plane and forms a guide surface for an oncoming successive sheet.

7. The apparatus defined in claim 1 wherein said end of said shank is provided with an inwardly projecting formation parallel to said side of said braking belt in a closed position of said clamping element and engaging flatly against a sheet clamped between said clamping element and said side of said braking belt.

8. The apparatus defined in claim 1, further comprising a guide table supporting said stretch from below.

9. The apparatus defined in claim 8 wherein said guide table is a suction table and said braking belt has suction holes ahead of a clamping region thereof in said direction.

10. The apparatus defined in claim 1 wherein said shank is formed with a magnetically attractable material and a magnet is provided below said shank to reinforce a clamping force with which said shank bears against a sheet.

11. The apparatus defined in claim 10, further comprising a guide table supporting said stretch from below, said magnet being provided on said table.

12. The apparatus defined in claim 10 wherein said magnet is on said braking belt.

13. The apparatus defined in claim 1 wherein said braking belt is one of a plurality of parallel transversely spaced apart braking belts, each of which is provided with at least one of said clamping elements, guide belts being provided above said plane in gaps between said braking belts.

14. The apparatus defined in claim 13 wherein said guide belts are perforated and pass below a suction box opening toward said plane over at least part of the length of said stretch.

15. The apparatus defined in claim 1 wherein said nonuniform drive means includes a nonuniformly controlled motor operatively connected to said braking belt.

16. The apparatus defined in claim 15, further comprising a nonuniformly speed changing transmission interposed between said motor and said braking belt.

17. The apparatus defined in claim 1 wherein said nonuniform drive means includes a uniformly driven motor operatively connected to said braking belt and a nonuniformly speed changing transmission interposed between said motor and said braking belt.

18. The apparatus defined in claim 17, further comprising a setting transmission operatively connected to said nonuniformly speed changing transmission.

19. The apparatus defined in claim 1 wherein said drive means includes a motor and a flywheel operatively connected to said motor.

* * * * *